US010892561B2

(12) United States Patent
Lin et al.

(10) Patent No.: US 10,892,561 B2
(45) Date of Patent: Jan. 12, 2021

(54) MULTI-BAND DUAL-POLARIZATION ANTENNA ARRAYS

(71) Applicant: MediaTek Inc., Hsinchu (TW)

(72) Inventors: Wun-Jian Lin, Hsinchu (TW); Shyh-Tirng Fang, Hsinchu (TW); Yeh-Chun Kao, Hsinchu (TW)

(73) Assignee: MediaTek Inc., Hsinchu (TW)

( * ) Notice: Subject to any disclaimer, the term of this patent is extended or adjusted under 35 U.S.C. 154(b) by 243 days.

(21) Appl. No.: 16/189,915

(22) Filed: Nov. 13, 2018

(65) Prior Publication Data

US 2019/0148839 A1 May 16, 2019

Related U.S. Application Data

(60) Provisional application No. 62/586,255, filed on Nov. 15, 2017.

(51) Int. Cl.

| | |
|---|---|
| ***H01Q 21/06*** | (2006.01) |
| ***H01Q 21/24*** | (2006.01) |
| ***H01Q 1/38*** | (2006.01) |
| ***H01Q 9/04*** | (2006.01) |
| ***H01Q 5/40*** | (2015.01) |
| ***H01Q 21/30*** | (2006.01) |

(52) U.S. Cl.

CPC ..... *H01Q 21/061* (2013.01); *H01Q 1/38* (2013.01); *H01Q 5/40* (2015.01); *H01Q 9/04* (2013.01); *H01Q 9/0407* (2013.01); *H01Q 21/065* (2013.01); *H01Q 21/24* (2013.01); *H01Q 21/30* (2013.01)

(58) Field of Classification Search

CPC ..... H01Q 21/061; H01Q 21/065; H01Q 5/40; H01Q 21/30; H01Q 9/0407; H01Q 21/24; H01Q 1/38; H01Q 9/04

See application file for complete search history.

(56) References Cited

U.S. PATENT DOCUMENTS

| | | | | |
|---|---|---|---|---|
| 6,211,841 | B1 * | 4/2001 | Smith | H01Q 1/246 343/797 |
| 6,515,628 | B2 | 2/2003 | Roberts | |
| 2009/0224995 | A1 * | 9/2009 | Puente | H01Q 1/42 343/850 |
| 2014/0028526 | A1 | 1/2014 | Cox | |
| 2016/0301144 | A1 * | 10/2016 | Xiao | H01Q 21/061 |
| 2018/0316098 | A1 * | 11/2018 | Amadjikpe | H01Q 9/0457 |
| 2019/0081414 | A1 * | 3/2019 | Kao | H01Q 25/001 |

* cited by examiner

*Primary Examiner* — Dameon E Levi
*Assistant Examiner* — David E Lotter
(74) *Attorney, Agent, or Firm* — Tong J. Lee

(57) ABSTRACT

A multi-band antenna array includes first antenna elements and second antenna elements. Each first antenna element has a first shape spanned by a first long axis and a first short axis, the first long axis being longer than and perpendicular to the first short axis. Each second antenna element has a second shape spanned by a second long axis and a second short axis, the second long axis being longer than and perpendicular to the second short axis. The first long axis is non-parallel to the second long axis. The first antenna element and the second antenna element resonate at a high resonance frequency band along the first long axis and the second long axis, respectively, and the first antenna element and the second antenna element further resonate at a low resonance frequency band along the first short axis and the second short axis, respectively.

21 Claims, 8 Drawing Sheets

MULTI-BAND DUAL-POLARIZATION ANTENNA ARRAYS

CROSS-REFERENCE TO RELATED APPLICATIONS

This application claims the benefit of U.S. Provisional Application No. 62/586,255 filed on Nov. 15, 2017, the entirety of which is incorporated by reference herein.

TECHNICAL FIELD

Embodiments of the invention relate to multi-band antenna arrays providing dual polarizations, and wireless devices including antenna arrays.

BACKGROUND

Wireless devices use antennas to transmit and receive wireless signals. Modern wireless devices, such as those operating in the 5G (fifth generation) mobile communication networks, use multi-band antennas capable of signaling (transmitting and/or receiving) at multiple frequency bands in the millimeter frequency spectrum (e.g., 6-400 GHz). Operation at these frequencies may encounter significant challenges. For example, millimeter wave communications typically do not navigate around or through obstacles effectively. Thus, millimeter wave signals may be substantially attenuated during signal propagations. In addition, many wireless devices, such as smartphone and smart watches, have a limited form factor which constrains the size of the antennas.

SUMMARY

In one embodiment, there is provided a multi-band antenna array comprising: a first antenna subarray including a plurality of first antenna elements; and a second antenna subarray including a plurality of second antenna elements. Each first antenna element has a first shape spanned by a first long axis and a first short axis, the first long axis being longer than the first short axis and perpendicular to the first short axis. Each second antenna element has a second shape spanned by a second long axis and a second short axis, the second long axis being longer than the second short axis and perpendicular to the second short axis. The first long axis is non-parallel to the second long axis. The first antenna element and the second antenna element resonate at a first resonance frequency band along the first long axis and the second long axis, respectively, and the first antenna element and the second antenna element further resonate at a second resonance frequency band along the first short axis and the second short axis, respectively. The first resonance frequency band is lower than the second resonance frequency band.

In another embodiment, there is provided a wireless device comprising: processing circuitry; memory and storage circuitry; and input/output (I/O) circuitry including a multi-band antenna array. The multi-band antenna array further comprises: a first antenna subarray including a plurality of first antenna elements; and a second antenna subarray including a plurality of second antenna elements. Each first antenna element has a first shape spanned by a first long axis and a first short axis, the first long axis being longer than the first short axis and perpendicular to the first short axis. Each second antenna element has a second shape spanned by a second long axis and a second short axis, the second long axis being longer than the second short axis and perpendicular to the second short axis. The first long axis is non-parallel to the second long axis. The first antenna element and the second antenna element resonate at a first resonance frequency band along the first long axis and the second long axis, respectively, and the first antenna element and the second antenna element further resonate at a second resonance frequency band along the first short axis and the second short axis, respectively. The first resonance frequency band is lower than the second resonance frequency band.

Advantages of the embodiments will be explained in detail in the following descriptions.

BRIEF DESCRIPTION OF THE DRAWINGS

The present invention is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one. Further, when a particular feature, structure, or characteristic is described in connection with an embodiment, it is submitted that it is within the knowledge of one skilled in the art to effect such feature, structure, or characteristic in connection with other embodiments whether or not explicitly described.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description. It will be appreciated, however, by one skilled in the art, that the invention may be practiced without such specific details. Those of ordinary skill in the art, with the included descriptions, will be able to implement appropriate functionality without undue experimentation.

Embodiments of multi-band dual polarization antenna arrays are described herein. Each antenna array described herein has a compact size suitable for wireless devices having a limited form factor. Each antenna array includes at least two subarrays for electromagnetically resonating in multiple frequencies (e.g., frequency bands) with two different polarizations. The subarrays of different polarizations may be nested into a constrained area, so as to improve the compactness of the antenna array. The antenna arrays may be used for millimeter wave communication, such as 5G mobile communications.

Figure 1:
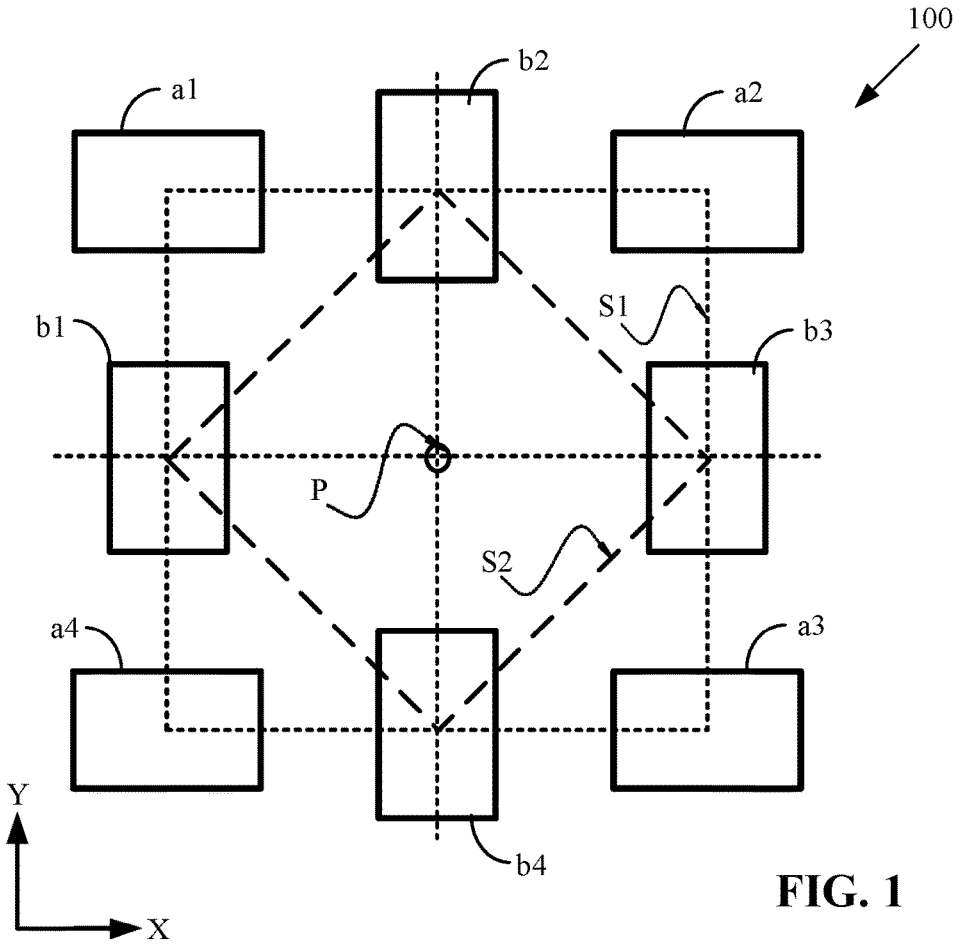
FIG. 1 illustrates a top view of an antenna array according to one embodiment.

FIG. 1 illustrates a top view of a multi-band dual polarization antenna array ("antenna array 100") according to an embodiment. The antenna array 100 includes a first subarray composed of a plurality of first antenna elements, such as a1, a2, a3 and a4 (referred to as "a1-a4"), and a second subarray composed of a plurality of second antenna elements, such as b1, b2, b3 and b4 (referred to as "b1-b4"). The first antenna elements (a1-a4) resonate at the same or substantially the same frequency bands as the second antenna elements (b1-b4). Furthermore, the first antenna elements (a1-a4) and the second antenna elements (b1-b4) operate in two different polarizations.

Figure 2A:
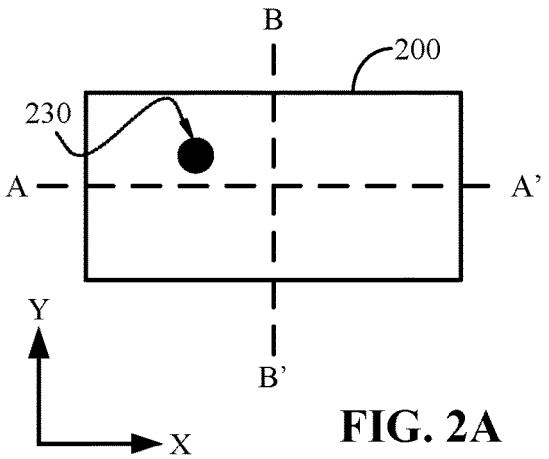
FIG. 2A illustrates a top view of an antenna element according to one embodiment.
Figure 2B:
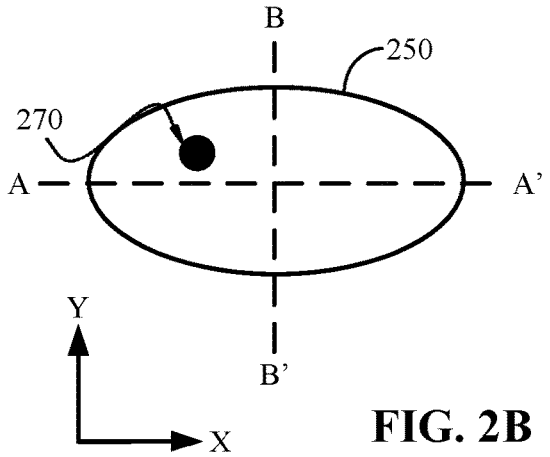
FIG. 2B illustrates a top view of an antenna element according to another embodiment.

In one embodiment, all of the first antenna elements (a1-a4) have the same geometric shape, such as the rectangular shape of FIG. 2A, the oval shape of FIG. 2B, or another geometric shape spanned by two orthogonal axes of two different lengths. Similarly, all of the second antenna elements (b1-b4) have the same geometric shape, such as the rectangular shape of FIG. 2A, the oval shape of FIG. 2B, or another geometric shape spanned by two orthogonal axes of two different lengths. In the embodiment of FIG. 1, all of the antenna elements (a1-a4 and b1-b4) have the same shape; that is, the rectangular shape. As will be described below, the antenna elements may have a different shape than the rectangular shape.

In one embodiment, all of the first antenna elements (a1-a4) may be placed in the antenna array 100 with a first orientation, and all of the second antenna elements (b1-b4) may be placed in the antenna array 100 with a second orientation, which is the first orientation rotated by 90 degrees. The orientation of an antenna element, as described herein, refers to the direction of the antenna element's axis (e.g., the long axis or the short axis, which will be explained in further detail with reference to FIGS. 2A and 2B). All of the first antenna elements may have the same size, and all of the second antenna elements may have the same size. In one embodiment, each first antenna element has the same or substantially the same size as each second antenna element. In an alternative embodiment, each first antenna element and each second antenna element may have different sizes. The exact size(s) of the first antenna element and the second antenna element may be determined at the antenna design time based on the frequency range(s) and the corresponding wavelengths for which the antenna array 100 provides. Furthermore, the spacing between the adjacent first antenna elements and between the adjacent second antenna elements may also be determined at the antenna design time based on the frequency range(s) and the corresponding wavelengths for which the antenna array 100 provides.

In one embodiment, the first antenna elements (a1-a4) may be arranged as a quadrilateral ("a first quadrilateral S1"); that is, when connecting the positions of adjacent antenna elements to form line segments, the line segments form the edges of the first quadrilateral S1 and the positions of the antenna elements form the vertices of the first quadrilateral S1. Examples of the quadrilateral include, but are not limited to, a rectangle, a parallelogram, a rhombus, or any four-sided shape with inner angles not greater than 180 degrees.

Similarly to the arrangement of the first antenna elements, the second antenna elements (b1-b4) may also be arranged as a quadrilateral ("a second quadrilateral S2"). In the embodiment of FIG. 1, the area of the first quadrilateral S1 is greater than the area of the second quadrilateral S2. In alternative embodiments, the first quadrilateral S1 and the second quadrilateral S2 may have the same size and/or the same shape but have different orientations. In another embodiment, the first quadrilateral S1 and the second quadrilateral S2 may have different sizes, different shapes, and/or different orientations.

In the embodiment of FIG. 1, the quadrilaterals S1 and S2 both have substantially the same shape (e.g., a square), with different sizes (S1 is larger than S2) and different orientations (S1 and S2 differ by a 90-degree rotation). The geometric center of S2 (indicated by P) lies within S1. In alternative embodiments, the shape of S1 and S2, the relative sizes of S1 and S2, and the relative orientations of S1 and S2 may vary to satisfy a design requirement; e.g., a required frequency range and/or required form factor.

In the following description, the term "antenna elements" collectively refers to both the first antenna elements (a1-a4) and the second antenna elements (b1-b4). Each of the antenna elements may be a patch antenna, such as a microstrip patch antenna, a PIFA (planar inverted-F antenna), a loop antenna, a slot antenna, etc.

In one embodiment, the antenna array described herein (such as the antenna array 100 and the various embodiments described below) may be implemented as an antenna-in-package (AiP) die (or dies) that may be mounted into a wireless device for operation in the millimeter wave bands.

FIG. 2A illustrates a top view of an antenna element 200 which may be used in a multi-band dual polarization antenna array (e.g., any of the antenna arrays described in connection with FIGS. 1 and 3-14) according to one embodiment. For example, the antenna elements 200 may be placed in the antenna array 100 of FIG. 1 as the first antenna elements (a1-a4), and may also be placed with 90-degree rotation as the second antenna elements (b1-b4) in the antenna array 100. The antenna element 200 when viewed from the top of an X-Y plane in a direction normal to the X-Y plane, has a rectangular shape. FIG. 2B illustrates a top view of an antenna element 250 which may be used in a multi-band dual polarization antenna array (e.g., any of the antenna arrays described in connection with FIGS. 1 and 3-14) according to another embodiment. For example, the antenna elements 250 may be placed in an antenna array 700 of FIG. 7 as the first antenna elements (a1-a4), and may also be placed with 90-degree rotation as the second antenna elements (b1-b4) in the antenna array 700. The antenna element 250 when viewed from the top of an X-Y plane in a direction normal to the X-Y plane, has an oval shape. Although the various embodiments shown in the figures herein have a rectangular shape, it is understood that all of the rectangular-shaped antenna elements shown in this disclosure may be replaced with oval-shaped antenna elements, or antenna elements of another shape spanned by two orthogonal axes of different lengths.

In one embodiment, each of the antenna element 200 and the antenna element 250 is symmetrical with respect to an axis A-A' (also referred to as a "long axis"), and is also symmetrical with respect to an axis B-B' (also referred to as a "short axis"), where both the A-A' axis and the B-B' axis lie on the X-Y plane. The long axis is longer than the short axis, and is orthogonal to the short axis; i.e., the two axes intersect at a 90-degree angle. In one embodiment, the antenna element 200 and the antenna element 250 resonate at a first resonance frequency band along (i.e., in the direction of) their respective long axes, and also resonate at a second resonance frequency band along their respective short axes, where the first resonance frequency band is lower than the second resonance frequency band.

The antenna element 200 and the antenna element 250 may be excited by probe feeds having feed points 230 and 270, respectively. The feed point 230 may be placed within the rectangular shape of the antenna element 200, and may not be placed on either the long axis or the short axis. Similarly, the feed point 270 may be placed within the oval shape of the antenna element 250, and may not be placed on either the long axis or the short axis.

According to embodiments of the invention, a multi-band dual polarization antenna array includes a plurality of antenna elements such as the antenna elements 200 of FIG. 2A and/or the antenna elements 250 of FIG. 2B. Antenna elements of other shapes may be included in addition or alternative to the antenna elements 200 and antenna elements 250. In some embodiments, a multi-band dual polarization antenna array may include a first subarray of antenna elements in a first orientation and a second subarray of antenna elements in a second orientation, where the long axis in the first orientation is nonparallel to the long axis in the second orientation. For example, the antenna array 100 of FIG. 1 includes first antenna elements (a1-a4) with their long axes parallel to the X axis (the first orientation), and second antenna elements (b1-b4) with their long axes parallel to the Y-axis (the second orientation). The two orthogonal orientations of the antenna elements provide two orthogonal polarizations. In an alternative embodiment, the orientations of the antenna elements in the two subarrays may be different and non-orthogonal to provide two different and non-orthogonal polarizations.

Figure 3:
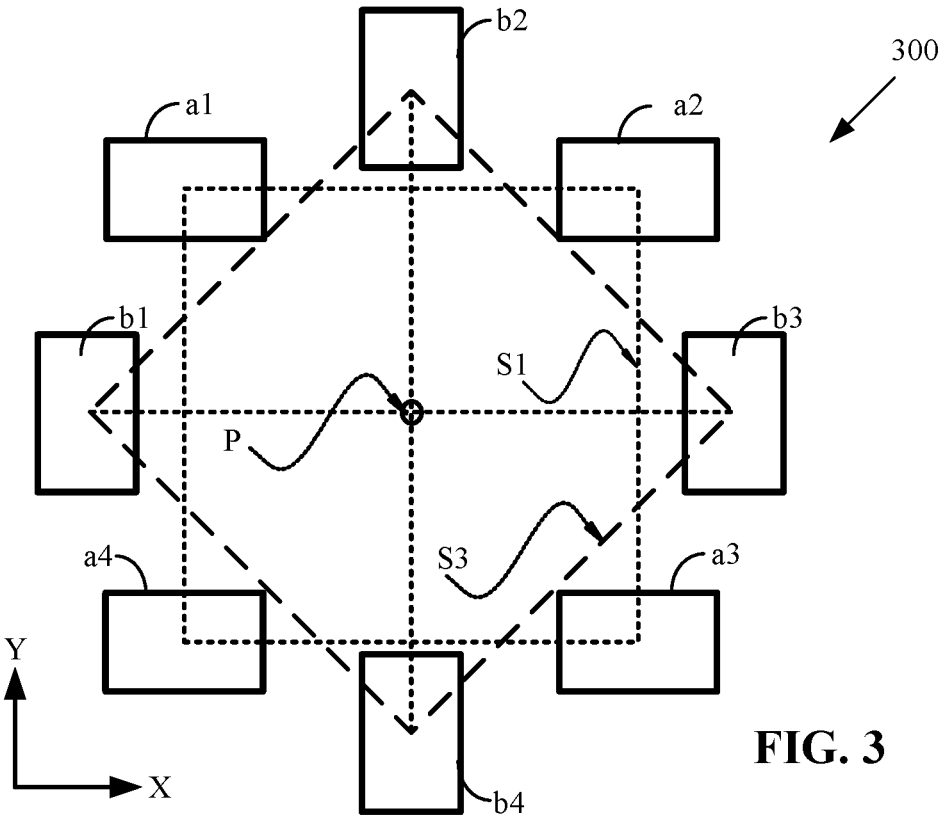
FIG. 3 illustrates a top view of an antenna array according to one embodiment.

FIG. 3 illustrates a multi-band dual polarization antenna array 300 ("antenna array 300") according to another embodiment. The antenna array 300 includes the same antenna elements (a1-a4 and b1-b4) as the antenna array 100 of FIG. 1, and the first antenna elements (a1-a4) form the same quadrilateral S1 as in FIG. 1. The second antenna elements (b1-b4) in the antenna array 300 form a quadrilateral S3, which has the same or substantially the same area size as the quadrilateral S1. The quadrilateral S3 is 90-degree rotated from the quadrilateral S1. The geometric center of the quadrilateral S2 is P, which is located within the quadrilateral S1.

Figure 4:
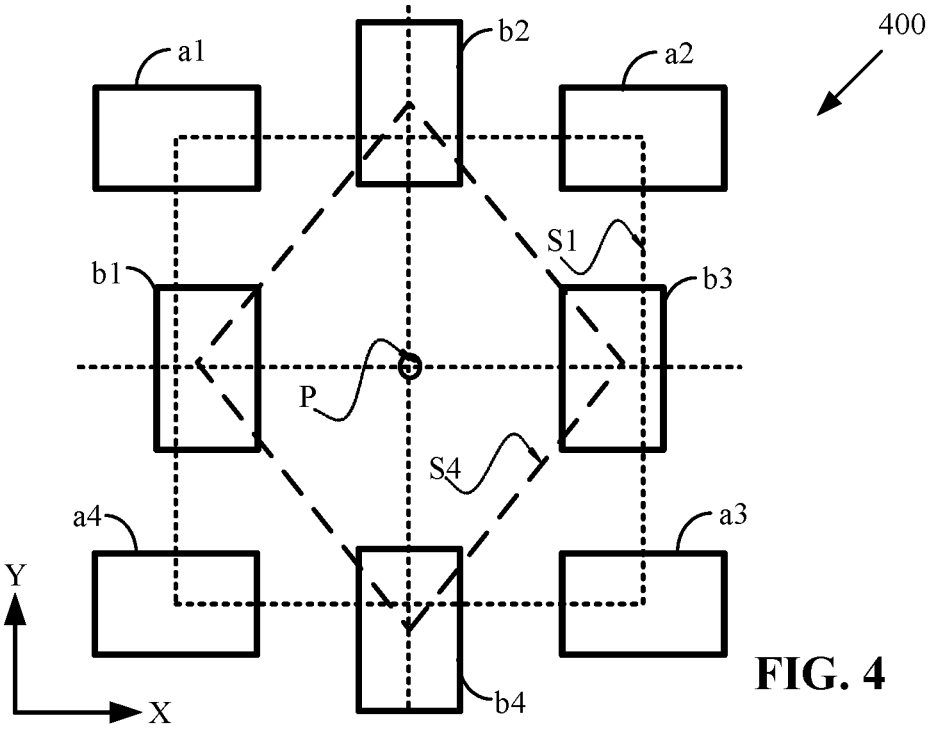
FIG. 4 illustrates a top view of an antenna array according to one embodiment.

FIG. 4 illustrates a multi-band dual polarization antenna array 400 ("antenna array 400") according to yet another embodiment. The antenna array 400 includes the same antenna elements (a1-a4 and b1-b4) as the antenna array 100 of FIG. 1, and the first antenna elements (a1-a4) form the same quadrilateral S1 as in FIG. 1. The second antenna elements (b1-b4) in the antenna array 400 form a quadrilateral S4. More specifically, the quadrilateral S4 is a rhombus. Unlike the quadrilateral S2 in FIG. 1 having four 90-degree angles, the quadrilateral S4 has two acute angles on opposite sides and two obtuse angels on the other opposite sides. The area of the quadrilateral S4 may be larger or may be smaller than the area of the quadrilateral S1. The geometric center of the quadrilateral S4 is P, which is located within the quadrilateral S1.

The aforementioned embodiments provide a number of variations of a multi-band dual polarization antenna array having two subarrays in two different orientations (e.g., the long axes of a first subarray aligned with the X-axis, and the long axes of a second subarray aligned with the Y-axis). The area of the quadrilateral formed by the second antenna elements (b1-b4) may be larger than, smaller than, or equal to the area of the quadrilateral S1. In some embodiments, the quadrilateral formed by the second antenna elements (b1-b4) may be rotated from the quadrilateral S1 by any degrees other than 90 degrees. Additionally, in the aforementioned embodiments the geometric center (P) of the quadrilateral formed by the second antenna elements (b1-b4) falls within the area of the quadrilateral S1. In some embodiments, the geometric center (P) may or may not coincide with the geometric center of the quadrilateral S1.

In some embodiments, each of the antenna elements (of the first and second subarrays) may be formed from patterned metal traces on a printed circuit board substrate. In some embodiments, all of the antenna elements may be disposed on the same surface of a printed circuit board substrate. Alternatively, the antenna elements may be disposed on multiple layers (i.e., multiple surfaces) of printed circuit board substrates.

Figure 5:
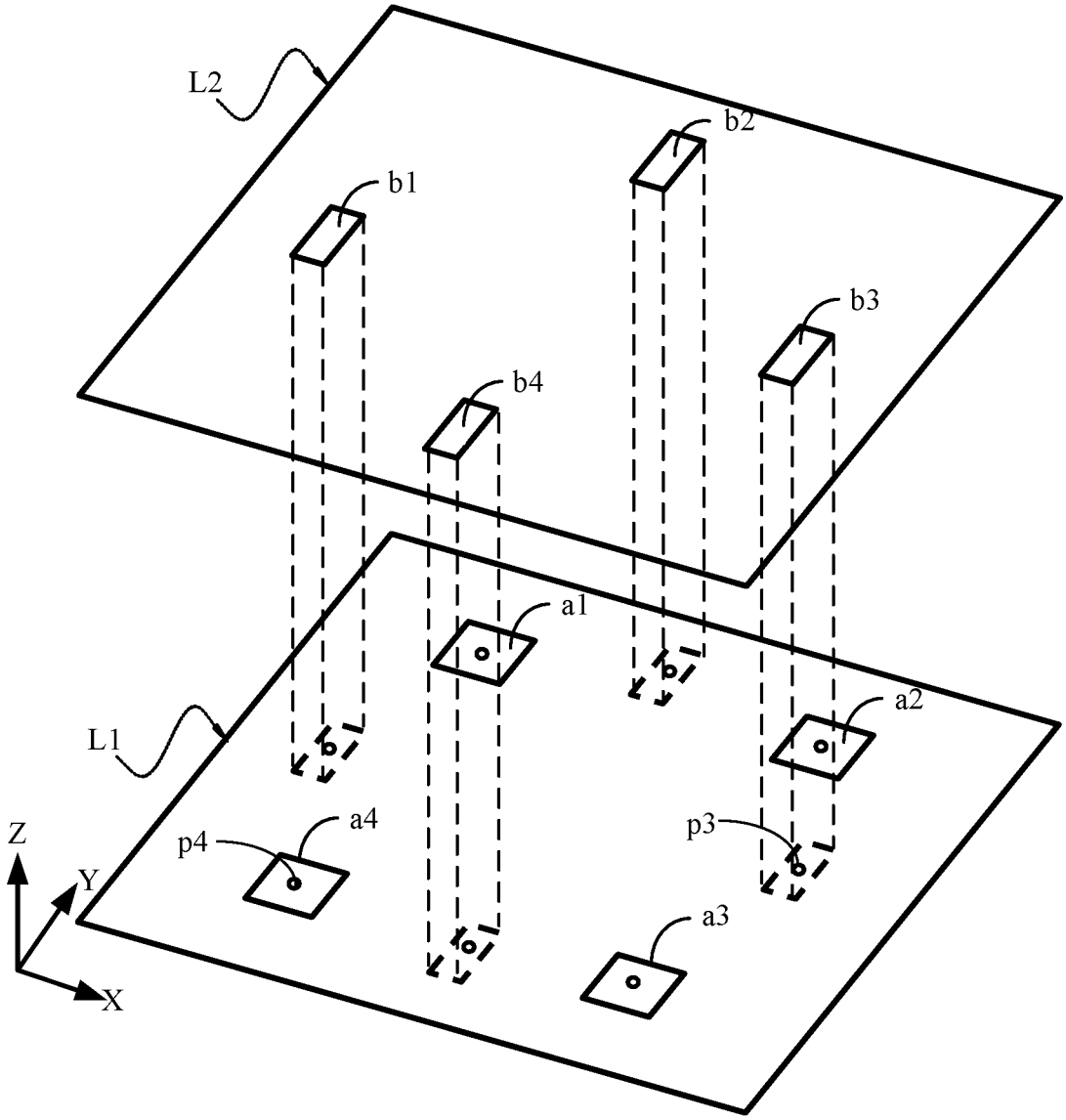
FIG. 5 illustrates a three-dimensional view of an antenna array including antenna elements disposed on more than one surface according to one embodiment.

FIG. 5 illustrates an example in which the first antenna elements (a1-a4) are disposed on a first surface L1 and the second antenna elements (b1-b4) are disposed on a second surface L2, where L1 is substantially parallel to L2. L1 and L2 may be the surfaces of different layers of printed circuit board substrates. In this example, both L1 and L2 are planar surfaces substantially parallel to each other. In an alternative embodiment, the first antenna elements (a1-a4) may be disposed on two or more substantially parallel surfaces. Similarly, the second antenna elements (b1-b4) may also be disposed on two or more substantially parallel surfaces. Both L1 and L2 are substantially parallel to the X-Y plane, a reference plane in the reference coordinate system. The term "substantially parallel" is used herein to mean that L1 and L2 are parallel or slightly deviated from being parallel. The slight deviation may come from the antenna manufacturing process and may be below an allowable tolerance value. It is understood that the terms "parallel" and "substantially parallel" may be used interchangeably in this disclosure to mean that two or more layers, surfaces, shapes, and/or alignments are parallel within an allowable tolerance value. It is also understood that various alignments of antenna elements or other components disclosed herein may be slightly deviated (within respective allowable tolerance values) from the described embodiments (e.g., due to the manufacturing process) and such slight deviations are within the scope of this disclosure.

Regardless of the total number of surfaces that the antenna elements (a1-a4 and b1-b4) may be on, these antenna elements or their projections to a reference surface may be arranged into two quadrilaterals as described in connection with FIGS. 1, 3 and 4, or other geometric shapes to be described below. This reference surface is parallel to all of the surfaces on which the antenna elements are disposed. In a scenario where all of the antenna elements are disposed on the same surface, this surface may be used as the reference surface. In another scenario where the antenna elements are disposed on two or more surfaces, the reference surface may be any one of these surfaces, a ground plane, or the X-Y plane. In one embodiment, the ground plane is a planar metal plate. Between the ground plane and the antenna elements may be a dielectric substrate. It is understood that the antenna elements in all of the embodiments of antenna arrays described herein may be disposed on more than one surface. Accordingly, it is understood that the various geometric shapes (e.g., quadrilaterals, linear arrays, etc.) formed by the antenna elements may be formed by the positions (physical positions or projected positions) of the antenna elements on a reference surface.

As used herein, the "position" of an antenna element may refer to its physical position on the reference surface (if that antenna element is disposed on the reference surface), or its projected position on the reference surface (if that antenna element is disposed on another surface parallel to the reference surface). The position of an antenna element may be defined by a reference point within the antenna element, such as a geometric center of the antenna element, or a midpoint on an edge of the antenna element, or a vertex on the perimeter of the antenna element, or the position of a feed point or a ground terminal of the antenna element. In an antenna array, all of the antenna elements use the same reference point definition to define their respective positions. For example, in the embodiment of FIG. 1, the geometric centers of the first antenna elements (a1-a4) may be used to define their respective positions that form the quadrilateral S1. If the second antenna elements (b1-b2) are disposed on another surface (e.g., L2) such as what is shown in FIG. 5, the geometric centers of the second antenna elements (b1-b4) projecting onto L1 may be used to define their respective positions that form the quadrilateral S2 (in FIG. 1).

In FIG. 5, the circles on L1 are used to show an example of antenna element positions on a reference surface (which is L1 in this example). Position p3 is an example of the (projected) position of b3, and position p4 is an example of the position of a4. The reference surface may be another surface (not shown) parallel to L1 and L2. Thus, the first antenna elements (a1-a4) when projected to a reference surface parallel to L1 and L2, have first reference positions on the reference surface. The second antenna elements (b1-b4) when projected to the reference surface, have second reference positions on the reference surface. In one embodiment, the first reference positions form a first quadrilateral, the second reference positions form a second quadrilateral, and a geometric center of the second quadrilateral lies within the first quadrilateral. In other embodiments (examples of which will be described with reference to FIG. 10 and FIG. 11), the first reference positions form a first linear array, and the second reference positions form a second linear array.

Figure 6:
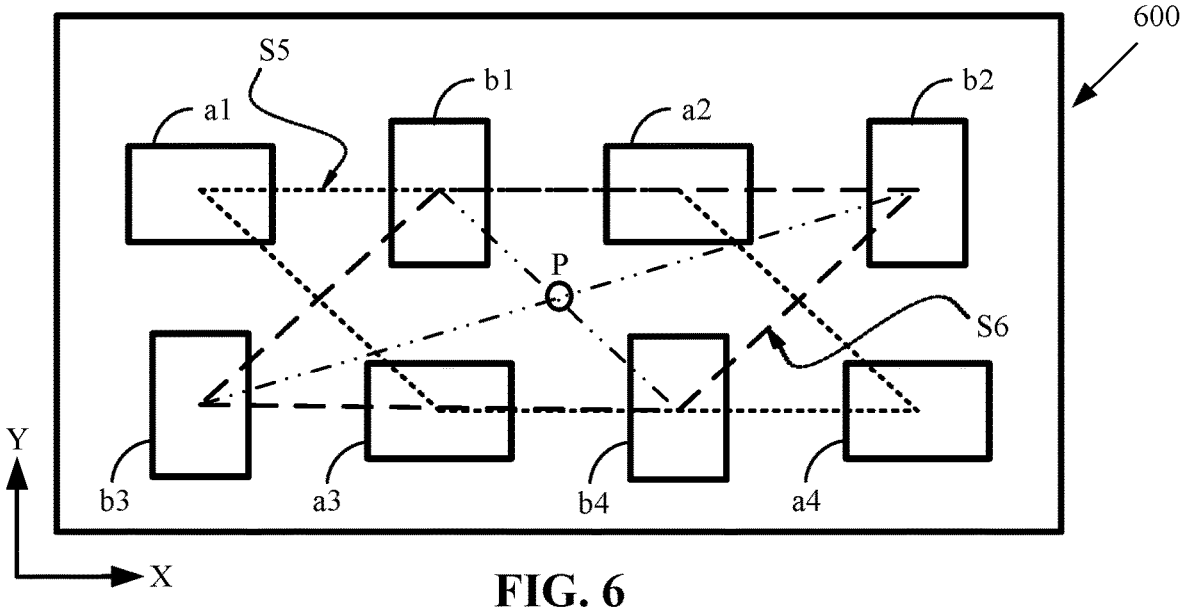
FIG. 6 illustrates a top view of an antenna array according to one embodiment.

FIG. 6 illustrates a multi-band dual polarization antenna array 600 ("antenna array 600") according to one embodiment. The antenna array 600 is formed by the first antenna elements (a1-a4) and the second antenna elements (b1-b4). The positions of the first antenna elements may be arranged into a parallelogram S5, and the positions of the second antenna elements may be arranged into another parallelogram S6. The geometric center of S6, denoted by P, is within the parallelogram S5.

Alternatively, the antenna array 600 may be viewed as two rows of linear arrays with interleaved first antenna elements and second antenna elements. Row one includes antenna elements a1, b1, a2 and b2, and row two includes antenna elements b3, a3, b4 and a4. In this example, in each row the long axes of the first antenna elements (a1-a4) and the short axes of the second antenna elements (b1-b4) are aligned with the X-axis in the reference coordinate system, and in each column the short axis of a first antenna element (a1, a2, a3 or a4) and the long axis of a second antenna element (b1, b2, b3 or b4) are aligned with the Y-axis. In one embodiment, the positions of the antenna elements in each of row one and row two form an equidistant linear array, or a substantially equidistant linear array.

Figure 7:
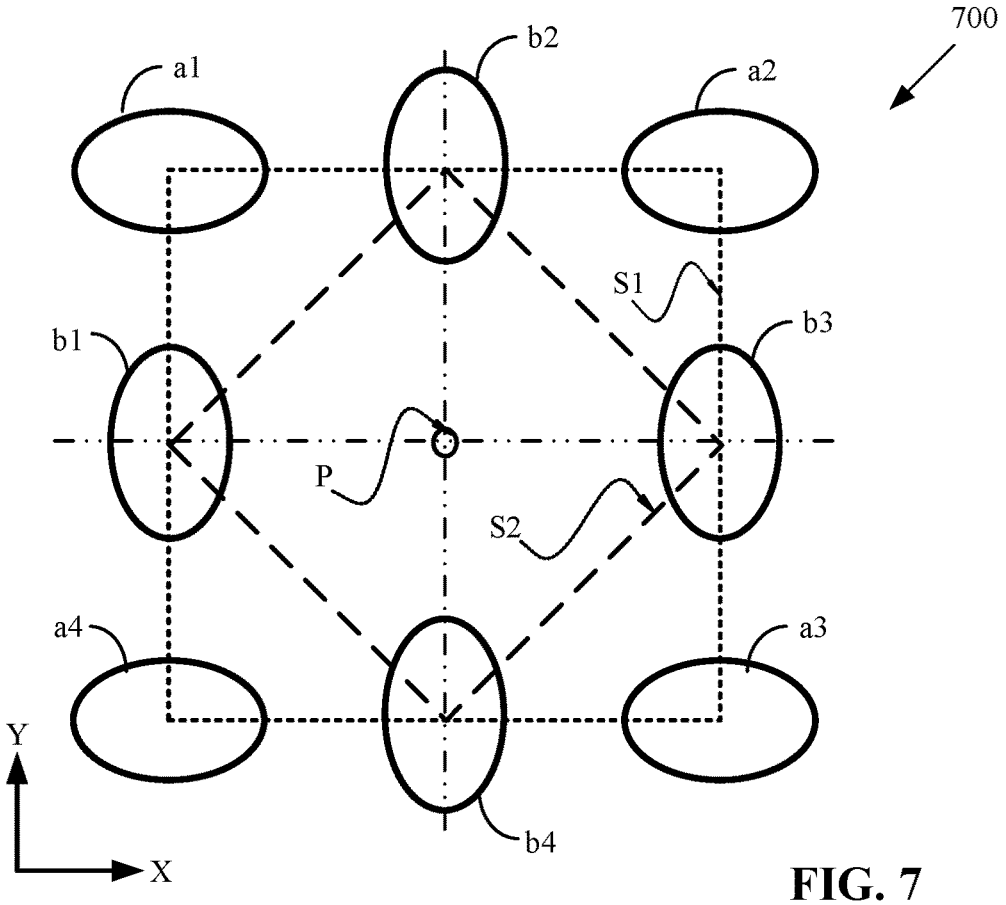
FIG. 7 illustrates a top view of an antenna array according to one embodiment.

FIG. 7 illustrates a multi-band dual polarization antenna array 700 according to one embodiment. The antenna array 700 has the same layout as the antenna array 100 in FIG. 1, except that each rectangle antenna element in the antenna array 100 is replaced by an oval-shaped antenna element (e.g., the antenna elements 250 in FIG. 2B) in the antenna array 700. As described in connection with FIG. 2A and FIG. 2B, the antenna elements described in the various embodiments herein may have any shape that is spanned by two orthogonal axes including a long axis and a short axis. It should be understood that an antenna element of an oval or a different shape may be used in any of the antenna arrays described in the various embodiments in this disclosure; the antenna array 100 of FIG. 1 is used herein as a non-limiting example of replacing rectangular-shaped antenna elements with oval-shaped antenna elements.

Figure 8:
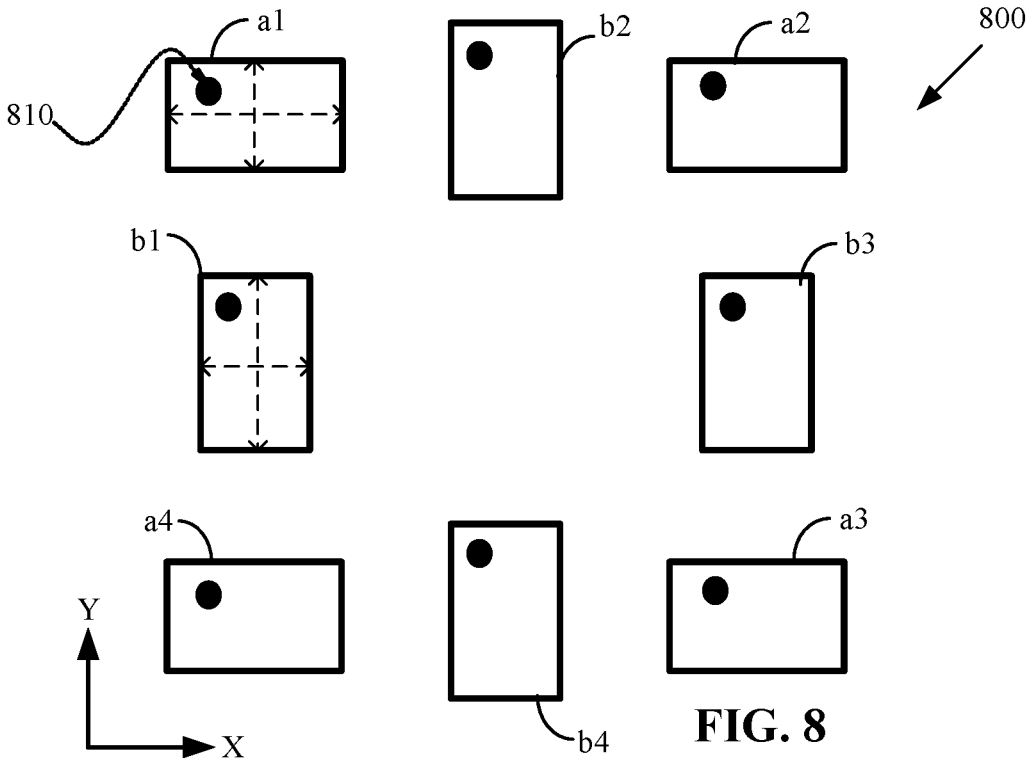
FIG. 8 illustrates a top view of an antenna array according to one embodiment.
Figure 9:
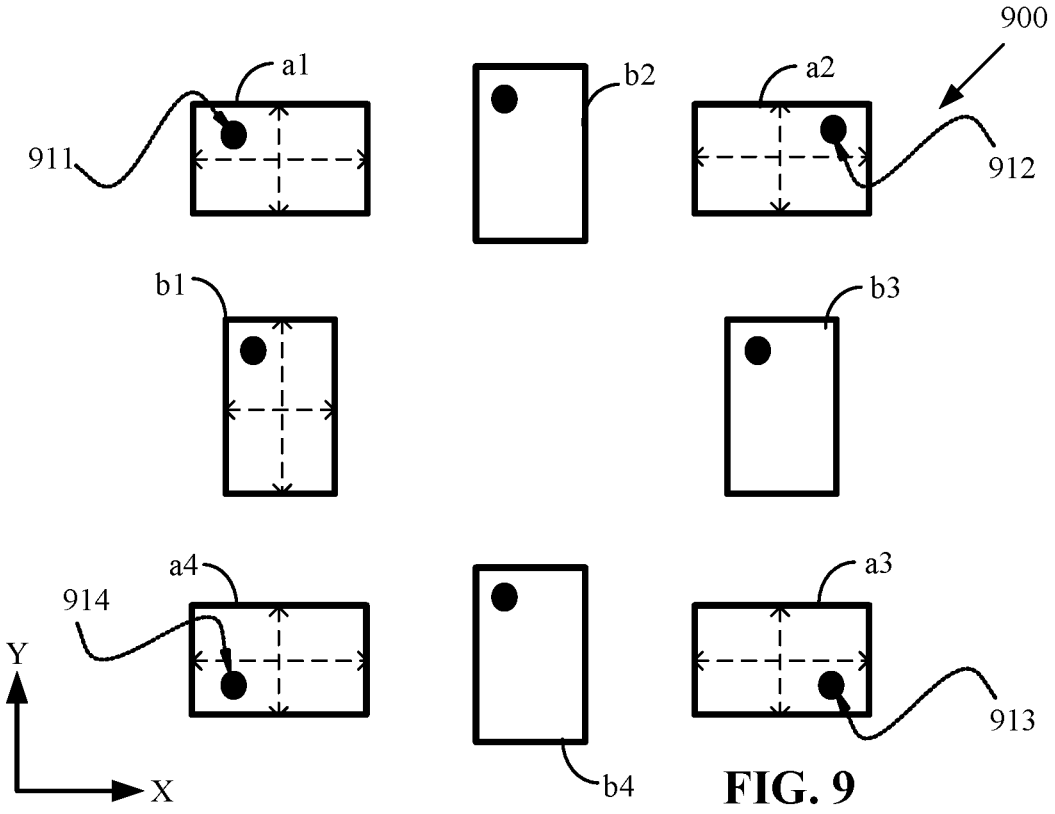
FIG. 9 illustrates a top view of an antenna array according to one embodiment.

FIG. 8 illustrates a multi-band dual polarization antenna array 800 ("antenna array 800") according to one embodiment. FIG. 9 illustrates a multi-band dual polarization antenna array 900 ("antenna array 900") according to another embodiment. FIG. 8 and FIG. 9 show the locations of feed points on each antenna element. A feed point, also referred to as a feed terminal, is a hardware component from which an antenna element receives power. A feed point may have any shape or structure, and be made of any materials suitable for the antenna element. Although feed points are not shown in the other embodiments described in this disclosure, it is understood that all of the antenna elements in all of the embodiments described herein include respective feed points.

In the antenna array 800, all feed points 810 (only one feed point is labeled for simplicity) are located in the same quadrant (e.g., upper left quadrant) of the antenna elements, where four quadrants are defined by the two axes (i.e., the long axis and the short axis, shown by dashed lines) of the antenna elements. For example, all feed points 810 are located in the upper left quadrant as shown in FIG. 8. In alternative embodiments, all feed points 810 may be located in the same quadrant different from the upper left quadrant. As described in connection with FIGS. 2A and 2B, the feed points do not lie on either of the long axis and the short axis. The exact locations of the feed points may be determined at the antenna design time based on; e.g., the required frequency of the antenna arrays.

With respect to the antenna array 900, the feed points of all second antenna elements (b1-b4) are located in the same quadrant (e.g., upper left quadrant) of the second antenna elements, where four quadrants are defined by the two axes (i.e., the long axis and the short axis, shown by dashed lines) of the second antenna elements. The feed points (911, 912, 913 and 914) of the first antenna elements (a1-a4) are located in their outer corner quadrants. That is, each first antenna element includes a feed point in an outer corner quadrant relative to a center of the antenna array 900. For example, the feed point 911 is located in the upper left quadrant, the feed point 912 is located in the upper right quadrant, the feed point 913 is located in the lower right quadrant, and the feed point 914 is located in the lower left quadrant of the respective first antenna elements.

Although the antenna arrays 800 and 900 are shown to have the same layout as the antenna array 100 of FIG. 1, it is understood that the locations of the feed points in the antenna arrays 800 and 900 are applicable to other embodiments of antenna arrays described herein, including different shapes of antenna elements and/or different geometric arrangements of antenna elements.

Figure 10:
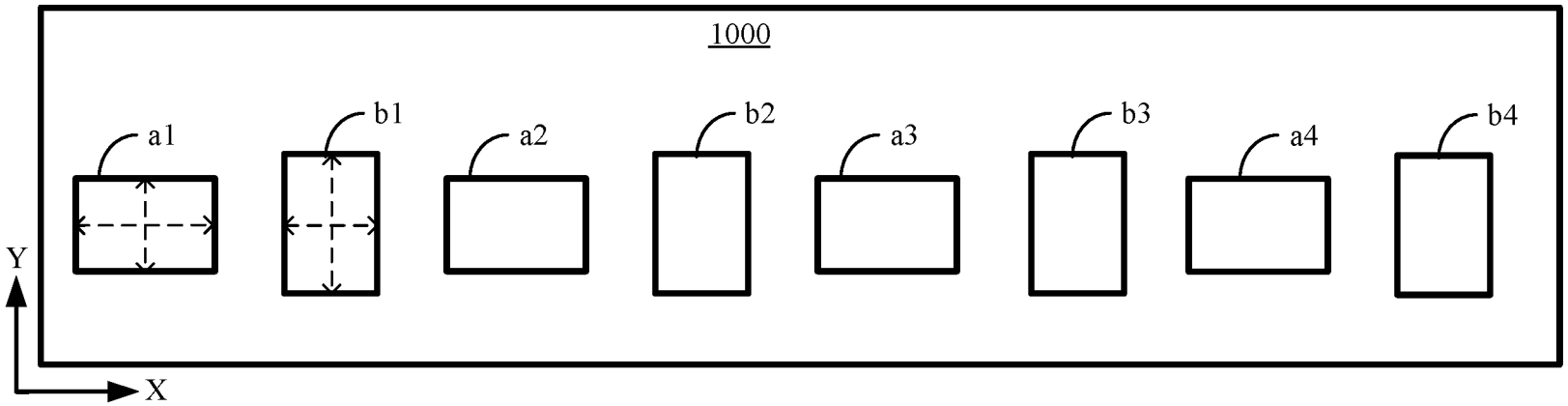
FIG. 10 illustrates a top view of an antenna array according to one embodiment.

FIG. 10 illustrates a multi-band dual polarization antenna array 1000 ("antenna array 1000") according to one embodiment. The antenna array 1000 includes the first antenna elements (a1-a4) arranged in a linear array, and the second antenna elements (b1-b4) also arranged in a linear array. More specifically, the positions of these antenna elements (a1-a4 and b1-b4) form a linear array with interleaved first antenna elements and second antenna elements. In this example, the long axes of the first antenna elements (a1-a4) and the short axes of the second antenna elements (b1-b4) are aligned with the X-axis (the axes are shown in dashed lines). In one embodiment, the positions of the antenna elements form an equidistant linear array, or a substantially equidistant linear array.

Figure 11:
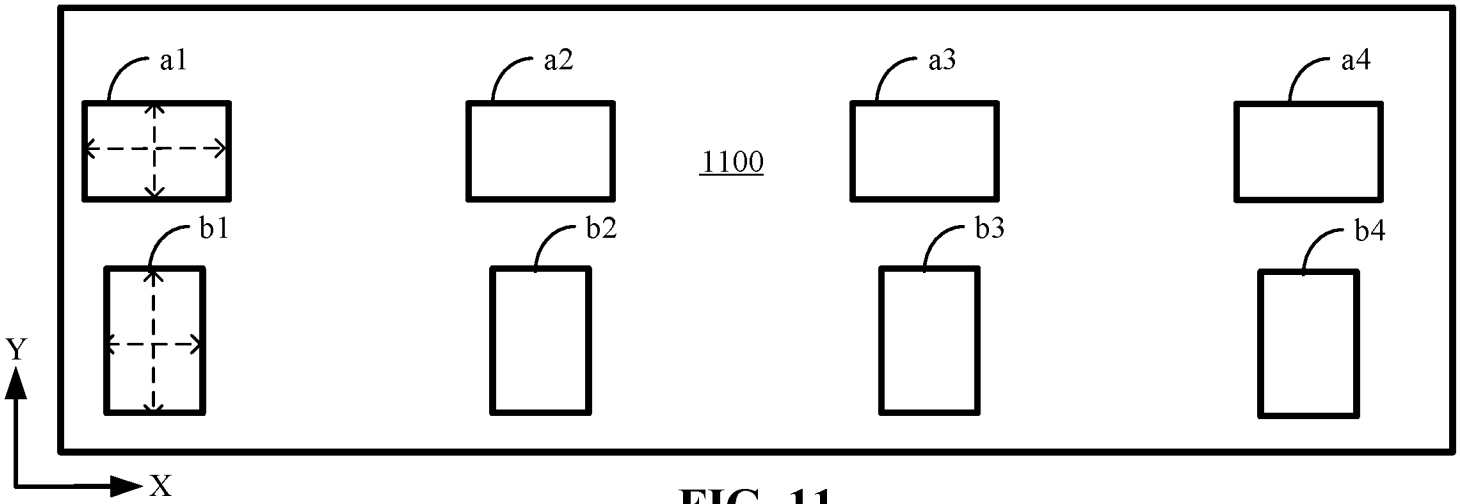
FIG. 11 illustrates a top view of an antenna array according to one embodiment.

FIG. 11 illustrates a multi-band dual polarization antenna array 1100 ("antenna array 1100") according to one embodiment. The antenna array 1100 includes the first antenna elements (a1-a4) arranged in a linear array, and the second antenna elements (b1-b4) also arranged in a linear array. More specifically, the positions of these antenna elements (a1-a4 and b1-b4) form two rows of linear arrays. In this example, in each row the long axes of the first antenna elements (a1-a4) and the short axes of the second antenna elements (b1-b4) are aligned with the X-axis, and in each column the short axis of a first antenna element (a1, a2, a3 or a4) and the long axis of a second antenna element (b1, b2, b3 or b4) are aligned with the Y-axis (the axes are shown in dashed lines). The first linear array (i.e., row one) extends in a first direction and the second linear array (i.e., row two) extends in a second direction parallel to the first direction. In one embodiment, the positions of the antenna elements in each of row one and row two form an equidistant linear array, or a substantially equidistant linear array.

Figure 12:
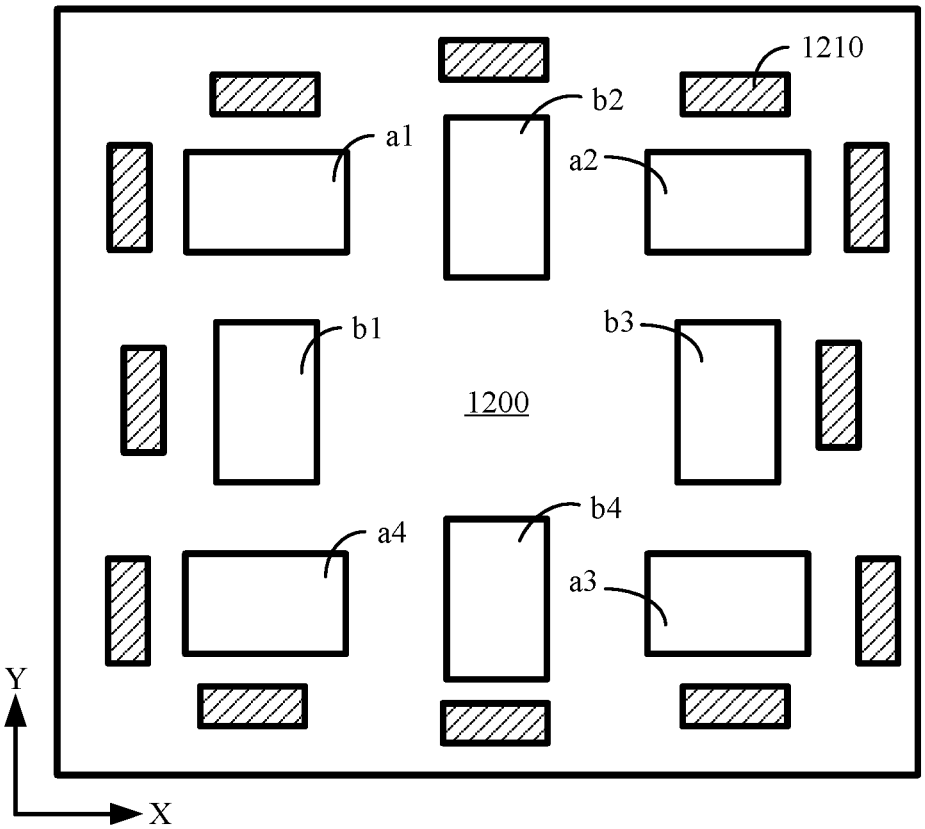
FIG. 12 illustrates a top view of an antenna array with parasitic elements according to one embodiment.

FIG. 12 illustrates a multi-band dual polarization antenna array 1200 ("antenna array 1100") according to one embodiment. The antenna array 1200 includes parasitic elements 1210 (e.g., reflectors and/or directors) which may be located on or near the surface(s) on which the antenna elements are disposed. The parasitic elements 1210 are not connected to a feed point. The use of the parasitic elements 1210 may enhance antenna operation bandwidth and may improve signal strength. The parasitic elements 1210 may be placed adjacent to the antenna elements; e.g., surrounding the outer perimeter of the antenna array 1200, at one or more sides of the antenna array 1200, above or on top of the antenna array 1200 or below or underneath the antenna array 1200. Each parasitic element 1210 may have a size and a shape suitable for the form factor of the antenna array 1200.

Although the antenna array 1200 is shown to have the same layout as the antenna array 100 of FIG. 1, it is understood that the parasitic elements 1210 in the antenna array 1200 are applicable to other embodiments of antenna arrays described herein, including different shapes of antenna elements and/or different geometric arrangements of antenna elements.

Figure 13:
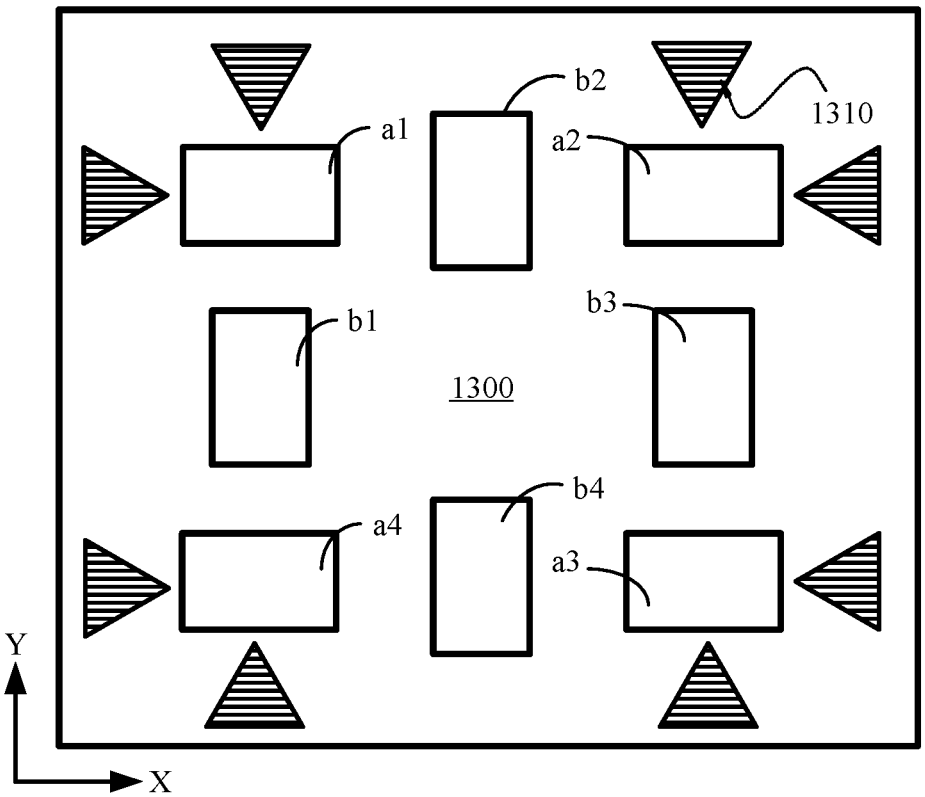
FIG. 13 illustrates a top view of an antenna array with end-fire antenna elements according to one embodiment.

FIG. 13 illustrates an antenna array 1300 according to one embodiment. The antenna array 1300 includes end-fire antenna elements 1310, in addition to the first antenna elements (a1-a4) and the second antenna elements (b1-b4). The first antenna elements (a1-a4) and the second antenna elements (b1-b4) produce a broadside field pattern, which is normal to the plane of the antenna array 1300 (i.e., perpendicular to the X-Y plane). The end-fire antenna elements 1310 produce an end-fire field pattern along the X-Y plane. The end-fire antenna elements 1310 may be located on or near the surface(s) on which the antenna elements are disposed. The end-fire antenna elements 1310 may be placed adjacent to the antenna elements; e.g., adjacent to the outer edge of each first antenna element, surrounding the outer perimeter of the antenna array 1300, or at one or more sides of the antenna array 1300. Each end-fire antenna element 1310 may have a size and a shape suitable for the form factor of the antenna array 1300.

Although the antenna array 1300 is shown to have the same layout as the antenna array 100 of FIG. 1, it is understood that the end-fire antenna elements 1310 in the antenna array 1300 are applicable to other embodiments of antenna arrays described herein, including different shapes of antenna elements and/or different geometric arrangements of antenna elements.

Figure 14:
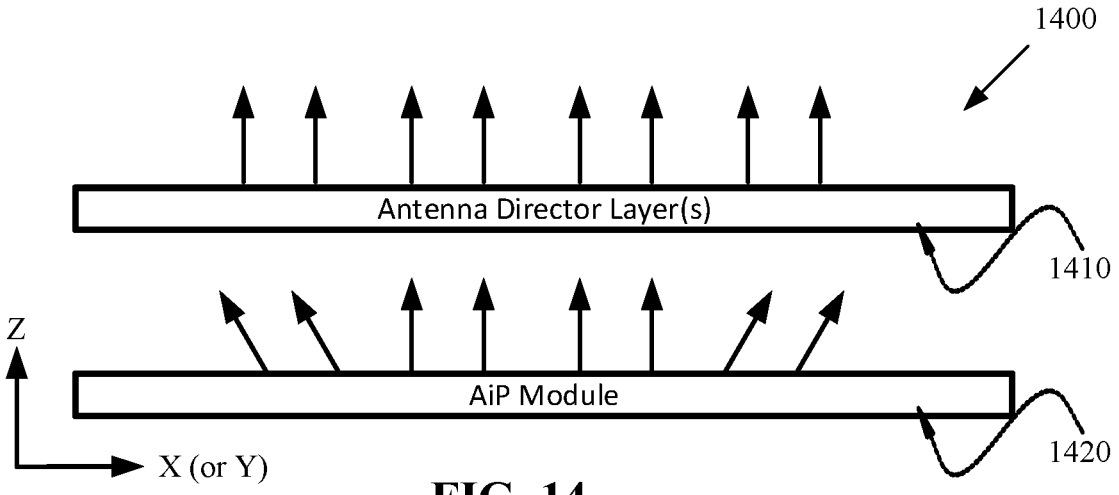
FIG. 14 illustrates an antenna array with one or more antenna director layers according to one embodiment.

FIG. 14 illustrates an antenna assembly 1400 according to one embodiment. The antenna assembly 1400 includes one or more antenna director layers 1410 parallel to an antenna array, which may be any of the aforementioned antenna arrays or their variations. In one embodiment, the antenna array may be an antenna-in-package (AiP) module 1420, which includes the aforementioned first antenna elements (a1-a4) and the second antenna elements (b1-b4) implemented on a die or dies according to any of the aforementioned embodiments. The one or more antenna director layers 1410 may be insulated from the AiP module 1420, e.g., be separated from the AiP module 1420 by dielectric materials and/or air-filled space. The antenna director layer (s) 1410 may be formed by metal(s) or material(s) of high dielectric constant(s), and may enhance the directional gain of the AiP module 1420. In one embodiment, the antenna director layer(s) 1410 may be or include the back cover of a wireless device, such as the wireless device to be described below with reference to FIG. 15.

Figure 15:
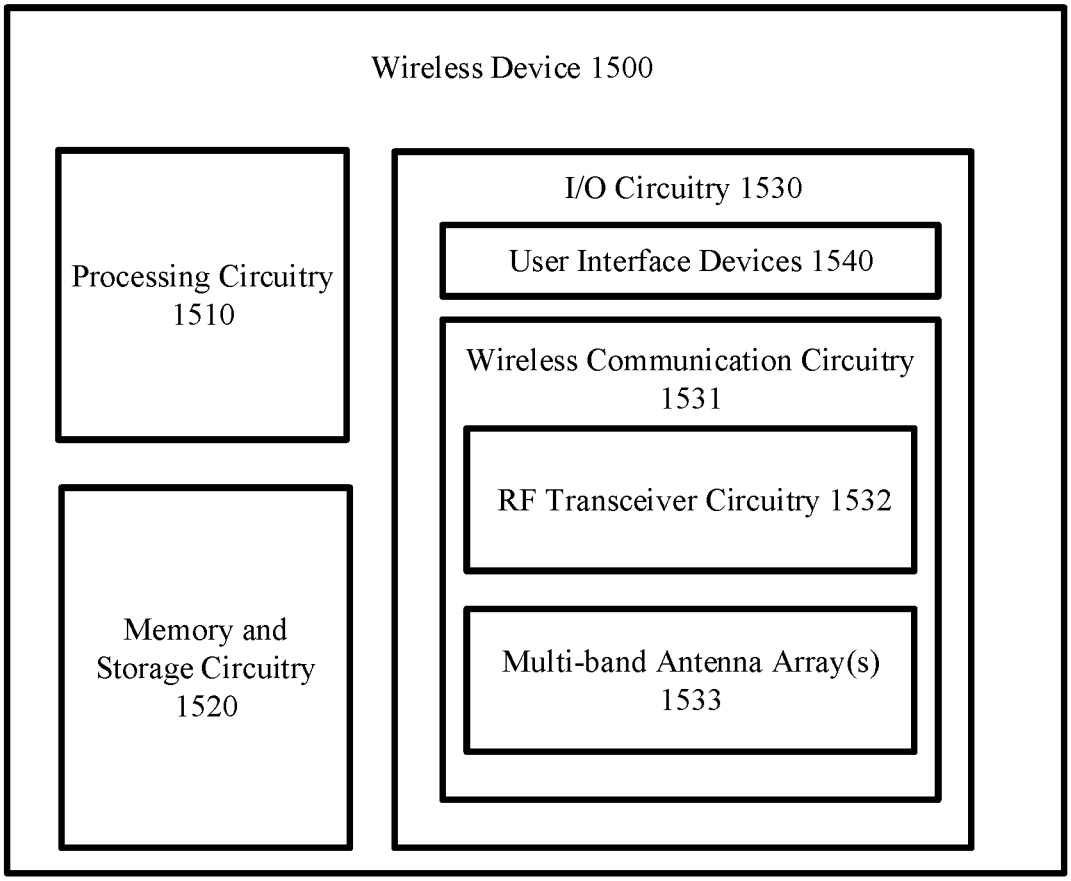
FIG. 15 illustrates a wireless device according to one embodiment.

FIG. 15 illustrates an example of a wireless device 1500 according to one embodiment. The wireless device 1500 may include any of the aforementioned multi-band antenna arrays or their variations for transmitting and/or receiving wireless signals. The wireless device 1500 includes processing circuitry 1510, which may further include one or more of: arithmetic and logic units (ALUs), control circuitry, cache memory, and/or other processing circuitry. Non-limiting examples of the wireless device 1500 include smartphones, smartwatches, tablets, laptops, Internet-of-things (IoT) devices, navigation devices, multimedia devices, and other computing and/or communication devices having wireless communication capabilities.

The wireless device 1500 further includes memory and storage circuitry 1520 coupled to the processing circuitry 1510. The memory and storage circuitry 1520 may include memory devices such as dynamic random access memory (DRAM), static RAM (SRAM), flash memory and other volatile or non-volatile memory devices. The memory and storage circuitry 1520 may further include storage devices, for example, any type of solid-state, magnetic and/or optical storage device.

The wireless device 1500 also includes input/output (I/O) circuitry 1530 which may further include user interface devices 1540, such as one or more of: a display, a speaker, a microphone, a camera, touch sensors, buttons, a keyboard and/or a keypad, etc. The I/O circuitry 1530 further include wireless communication circuitry 1531 for communicating wirelessly with external systems. The wireless communication circuitry 1531 may include radio-frequency (RF) transceiver circuitry 1532 for handling various RF communication bands used in one or more of: WiFi, Bluetooth, cellular, Global Positioning System (GPS), millimeter wave, any short-range and/or long-range networks. In one embodiment, the wireless communication circuitry 1531 includes a multi-band antenna array 1533 coupled to the RF transceiver circuitry 1532. The multi-band antenna array 1533 may include one or more of the aforementioned antenna arrays and/or their variations; e.g., the antenna arrays and antenna elements shown and/or described with reference to FIGS. 1-14.

While the invention has been described in terms of several embodiments, those skilled in the art will recognize that the invention is not limited to the embodiments described, and can be practiced with modification and alteration within the spirit and scope of the appended claims. The description is thus to be regarded as illustrative instead of limiting.

What is claimed is:

1. A multi-band antenna array, comprising:

a first antenna subarray including a plurality of first antenna elements; and a second antenna subarray including a plurality of second antenna elements, wherein each first antenna element has a first shape spanned by a first long axis and a first short axis, the first long axis being longer than the first short axis and perpendicular to the first short axis, wherein each second antenna element has a second shape spanned by a second long axis and a second short axis, the second long axis being longer than the second short axis and perpendicular to the second short axis, wherein the first long axis is non-parallel to the second long axis, and wherein the first antenna element and the second antenna element resonate at a first resonance frequency band along the first long axis and the second long axis, respectively, and the first antenna element and the second antenna element further resonate at a second resonance frequency band along the first short axis and the second short axis, respectively, the first resonance frequency band being lower than the second resonance frequency band.

2. The multi-band antenna array of claim 1, wherein the first antenna subarray and the second antenna subarray resonate at substantially same frequency bands and in two different polarizations.

3. The multi-band antenna array of claim 2, wherein the two different polarizations are orthogonal.

4. The multi-band antenna array of claim 1, wherein the first antenna elements and the second antenna elements are disposed on one or more parallel planar surfaces.

5. The multi-band antenna array of claim 4, wherein:

the first antenna elements when projected to a reference surface parallel to the one or more parallel planar surfaces, have first reference positions on the reference surface, the second antenna elements when projected to the reference surface, have second reference positions on the reference surface, the first reference positions form a first quadrilateral, and the second reference positions form a second quadrilateral, and a geometric center of the second quadrilateral lies within the first quadrilateral.

6. The multi-band antenna array of claim 5, wherein the second quadrilateral is substantially 90-degree rotated from the first quadrilateral.

7. The multi-band antenna array of claim 5, wherein:

the first antenna elements when projected to a reference surface parallel to the one or more parallel planar surfaces, have first reference positions on the reference surface, the second antenna elements when projected to the reference surface, have second reference positions on the reference surface, and the first reference positions form a first linear array, and the second reference positions form a second linear array.

8. The multi-band antenna array of claim 7, wherein the first antenna elements interleave with the second antenna elements to form one or more linear arrays.

9. The multi-band antenna array of claim 7, wherein the first linear array extends in a first direction and the second linear array extends in a second direction parallel to the first direction.

10. The multi-band antenna array of claim 1, wherein each of the first antenna elements and the second antenna elements includes a feed point in a same one of four quadrants, the four quadrants defined by respective two axes of each first antenna element and each second antenna element.

11. The multi-band antenna array of claim 1, wherein each first antenna element includes a first feed point in an outer corner quadrant relative to a center of the multi-band antenna array, and each second antenna element includes a second feed point in a same one of four quadrants defined by two axes of the second antenna element.

12. The multi-band antenna array of claim 1, wherein each of the first antenna elements and the second antenna elements has a rectangle shape.

13. The multi-band antenna array of claim 1, wherein each of the first antenna elements and the second antenna elements has an oval shape.

14. The multi-band antenna array of claim 1, wherein the first shape is substantially 90-degree rotated from the second shape.

15. The multi-band antenna array of claim 1, further comprising: parasitic elements adjacent to the first antenna elements and the second antenna elements.

16. The multi-band antenna array of claim 1, further comprising: end-fire antenna elements adjacent to an outer edge of each first antenna element.

17. The multi-band antenna array of claim 1, further comprising: one or more antenna director layers parallel to one or more planar surfaces on which the first antenna elements and the second antenna elements are disposed.

18. A wireless device, comprising:

processing circuitry;

memory and storage circuitry; and input/output (I/O) circuitry including a multi-band antenna array, the multi-band antenna array further comprising:

a first antenna subarray including a plurality of first antenna elements; and a second antenna subarray including a plurality of second antenna elements, wherein each first antenna element has a first shape spanned by a first long axis and a first short axis, the first long axis being longer than the first short axis and perpendicular to the first short axis, wherein each second antenna element has a second shape spanned by a second long axis and a second short axis, the second long axis being longer than the second short axis and perpendicular to the second short axis, wherein the first long axis is non-parallel to the second long axis, and wherein the first antenna element and the second antenna element resonate at a first resonance frequency band along the first long axis and the second long axis, respectively, and the first antenna element and the second antenna element further resonate at a second resonance frequency band along the first short axis and the second short axis, respectively, the first resonance frequency band being lower than the second resonance frequency band.

19. The wireless device of claim 18, wherein the first antenna subarray and the second antenna subarray resonate at substantially same frequency bands and in two different polarizations.

20. The wireless device of claim 18, wherein:

the first antenna elements, when projected to a reference surface parallel to one or more parallel planar surfaces on which the first antenna elements and the second antenna elements are disposed, have first reference positions on the reference surface, the second antenna elements when projected to the reference surface, have second reference positions on the reference surface, the first reference positions form a first quadrilateral, and the second reference positions form a second quadrilateral, and a geometric center of the second quadrilateral lies within the first quadrilateral.

21. The wireless device of claim 18, wherein:

the first antenna elements when projected to a reference surface parallel to one or more parallel planar surfaces on which the first antenna elements and the second antenna elements are disposed, have first reference positions on the reference surface, the second antenna elements when projected to the reference surface, have second reference positions on the reference surface, and the first reference positions form a first linear array, and the second reference positions form a second linear array.

* * * * *